US012023596B2

(12) United States Patent
Su

(10) Patent No.: US 12,023,596 B2
(45) Date of Patent: Jul. 2, 2024

(54) SMART MAGIC CUBE AND SENSOR USED THEREBY, SMART CENTER SHAFT, AND MONITORING METHOD

(71) Applicant: FS GIIKER TECHNOLOGY CO., LTD., Guangdong (CN)

(72) Inventor: Ziming Su, Foshan (CN)

(73) Assignee: FS GIIKER TECHNOLOGY CO., LTD., Foshan (CN)

( * ) Notice: Subject to any disclaimer, the term of this patent is extended or adjusted under 35 U.S.C. 154(b) by 232 days.

(21) Appl. No.: 17/623,512

(22) PCT Filed: Jan. 15, 2020

(86) PCT No.: PCT/CN2020/072280
§ 371 (c)(1),
(2) Date: Dec. 28, 2021

(87) PCT Pub. No.: WO2021/000580
PCT Pub. Date: Jan. 7, 2021

(65) Prior Publication Data

US 2022/0339530 A1 Oct. 27, 2022

(30) Foreign Application Priority Data

Jul. 3, 2019 (CN) ..... 201910594102.3

(51) Int. Cl.
*A63F 9/08* (2006.01)
*A63F 9/24* (2006.01)
*A63F 9/34* (2006.01)

(52) U.S. Cl.
CPC ..... *A63F 9/0842* (2013.01); *A63F 9/24* (2013.01); *A63F 9/34* (2013.01)

(58) Field of Classification Search
None
See application file for complete search history.

(56) References Cited

U.S. PATENT DOCUMENTS 4,817,952 A 4/1989 Biro et al.
11,559,734 B2 * 1/2023 Jiang ..... A63F 9/0612
(Continued)

FOREIGN PATENT DOCUMENTS

CN 106110651 B 11/2017
CN 108479055 A 9/2018
(Continued)

OTHER PUBLICATIONS

Patent Cooperation Treaty: International Search Report and Written Opinion for PCT/CN2020/072280; Apr. 13, 2020; 12 pages.
(Continued)

*Primary Examiner* — Sunit Pandya

(57) ABSTRACT

A sensor used by a smart magic cube is disclosed. The sensor includes: a stator configured to be fixedly disposed on the smart magic cube; a first rotor rotatable in synchronization with a first magic cube layer of the smart magic cube, such that when the first rotor rotates with the first magic cube layer with respect to the stator, the stator or the first rotor outputs a rotation signal of the first magic cube layer; and a second rotor rotatable in synchronization with a second magic cube layer of the smart magic cube, such that when the second rotor rotates with the second magic cube layer with respect to the stator, the stator or the second rotor outputs a rotation signal of the second magic cube layer. A smart center shaft, a smart magic cube and a monitoring method for the smart magic cube are also disclosed.

12 Claims, 10 Drawing Sheets

(56) References Cited

U.S. PATENT DOCUMENTS

| | | | | |
|---|---|---|---|---|
| 2013/0005420 | A1 | 1/2013 | Ueno et al. | |
| 2019/0184275 | A1* | 6/2019 | Su | A63F 9/0834 |
| 2020/0009451 | A1* | 1/2020 | Dor | A63F 13/35 |
| 2022/0080297 | A1* | 3/2022 | Su | A63F 9/0826 |

FOREIGN PATENT DOCUMENTS

| | | | |
|---|---|---|---|
| CN | 108525283 | A | 9/2018 |
| CN | 109675297 | A | 4/2019 |
| CN | 110180165 | A | 8/2019 |
| CN | 110327617 | A | 10/2019 |
| CN | 110368669 | A | 10/2019 |
| CN | 210448058 | U | 5/2020 |
| WO | 2018138586 | A2 | 8/2018 |

OTHER PUBLICATIONS

Chinese Patent Office: Office Action of CN 201910594102.3 (related application); Jul. 27, 2023; 9 pages.

* cited by examiner

SMART MAGIC CUBE AND SENSOR USED THEREBY, SMART CENTER SHAFT, AND MONITORING METHOD

CROSS-REFERENCE TO RELATED APPLICATIONS

This application is a U.S. National Phase application submitted under 35 U.S.C. § 371 of Patent Cooperation Treaty application serial no. PCT/CN2020/072280, filed Jan. 15, 2020, and entitled SMART MAGIC CUBE AND SENSOR USED THEREBY, SMART CENTER SHAFT, AND MONITORING METHOD, which application claims priority to Chinese patent application serial no. 201910594102.3, filed Jul. 3, 2019.

Patent Cooperation Treaty application serial no. PCT/CN2020/072280, published as WO 2021/000580 A1, and Chinese patent application serial no. CN 201910594102.3 are incorporated herein by reference.

TECHNICAL FIELD

The present disclosure relates to the technical field of magic cube, and more particularly, to a smart magic cube and a sensor used thereby, a smart center shaft, and a monitoring method.

BACKGROUND

The magic cube includes a center shaft and a plurality of magic blocks mounted on the center shaft. The center shaft includes a core and a number of connecting rods arranged at intervals on the core. Generally, the magic blocks include corner blocks, edge blocks, and center blocks (there is no center block in some low-order magic cubes). The plurality of magic blocks are spliced together to form a number of magic cube layers and a number of magic cube faces. For a high-order magic cube (e.g., a regular four-order magic cube, a regular five-order magic cube, or a three-order pyramid magic cube), the connecting rod is provided with at least two magic cube layers, and the at least two magic cube layers are rotatable around an axis of the connecting rod.

A smart magic cube is a new type of electronic magic cube that senses the rotation of the magic cube layers and the real-time state of the magic cube through a sensor, and processes, stores and transmits information such as the real-time state, the rotation and the like to an external device. A smart center shaft of the smart magic cube is the most core part of the smart magic cube. The smart center shaft can detect a rotation signal of each magic cube layer of the magic cube to obtain a real-time state of the whole magic cube, and can further communicate with an electronic device outside the magic cube in real time.

Conventional sensors can only be applied to low-order cubes, but for high-order cubes (e.g., regular four-order cubes, regular five-order cubes, or three-order pyramid cubes), there is no corresponding sensors to detect the rotation signals of the magic cube layers.

SUMMARY

In view of the above, in order to solve the problem that the conventional sensor cannot detect the rotation signal of the high-order magic cube, it is necessary to provide a smart magic cube and a sensor used thereby, a smart center shaft, and a monitoring method. The sensor can detect rotation signals of "two magic cube layers" of a high-order magic cube in real time by using a structure of "one stator and two rotors", so as to realize the intelligence of the high-order magic cube.

A sensor used by a smart magic cube is provided, the sensor including:

a stator, configured to be fixedly disposed on the smart magic cube;

a first rotor, configured to be rotatable in synchronization with a first magic cube layer of the smart magic cube, such that when the first rotor rotates with the first magic cube layer with respect to the stator, the stator or the first rotor is capable of outputting a rotation signal of the first magic cube layer; and a second rotor, configured to be rotatable in synchronization with a second magic cube layer of the smart magic cube, such that when the second rotor rotates with the second magic cube layer with respect to the stator, the stator or the second rotor is capable of outputting a rotation signal of the second magic cube layer.

The above sensor can be applied to a smart magic cube. The stator is fixedly disposed so as not to rotate with the rotation of the magic cube layer. The first rotor can rotate with the first magic cube layer with respect to the stator, so that the sensor can output the rotation signal of the first magic cube layer according to the relative rotation between the first rotor and the stator. The second rotor can rotate with the second magic cube layer with respect to the stator, so that the sensor can output the rotation signal of the second magic cube layer according to the relative rotation between the second rotor and the stator. In this way, the sensor can detect the rotation signals of the "two magic cube layers" of the smart magic cube by using the structure of "one stator and two rotors", thereby facilitating acquiring a state signal of the smart magic cube in a next step.

In an embodiment, the stator includes a first sensing plate, a second sensing plate, and a fixing seat, and the first sensing plate and the second sensing plate are fixedly mounted on both sides of the fixing seat, respectively. The first sensing plate is configured to sense a rotation signal of the first rotor, and the second sensing plate is configured to sense a rotation signal of the second rotor.

In an embodiment, the first sensing plate is provided with a first signal leading-out end on a side close to the fixing seat, the first sensing plate is provided with a first sensing surface on a side far from the fixing seat, and the first sensing surface is configured to sense the rotation signal of the first rotor; and/or the second sensing plate is provided with a second signal leading-out end on a side close to the fixing seat, the second sensing plate is provided with a second sensing surface on a side far from the fixing seat, and the second sensing surface is configured to sense the rotation signal of the second rotor.

In an embodiment, the fixing seat is provided with a first mounting chamber for mounting and fixing the first sensing plate; and/or the fixing seat is provided with a second mounting chamber for mounting and fixing the second sensing plate.

In an embodiment, a side of the stator is provided with a first sensing portion configured to sense a rotation signal of the first rotor, and another side of the stator is provided with a second sensing portion configured to sense a rotation signal of the second rotor.

In an embodiment, the first sensing portion and/or the second sensing portion includes a wire connecting ring and a sensing ring, the sensing ring is configured to sense a rotation signal of the first rotor or the second rotor, and the wire connecting ring is provided with a wire connecting end configured to output the rotation signal; or the first sensing portion and/or the second sensing portion include a wire connecting layer and a sensing layer, the sensing layer is configured to sense a rotation signal of the first rotor or the second rotor, and the wire connecting layer is provided with a wire connecting end configured to output the rotation signal.

In an embodiment, the sensor further includes a movable seat, the movable seat is provided with an accommodating chamber on a side towards the stator. When the movable seat is configured to be connected to the first magic cube layer, the accommodating chamber is configured to fixedly mount the first rotor, or when the movable seat is configured to be connected to the second magic cube layer, the accommodating chamber is configured to fixedly mount the second rotor.

In an embodiment, the first rotor or the second rotor is an electrically conductive member, the electrically conductive member includes a first electrical contact pin and a second electrical contact pin, and correspondingly, the stator is provided with a common signal ring and an angle signal ring insulated from the common signal ring, the first electrical contact pin is configured to contact the common signal ring and the second electrical contact pin is configured to contact different positions of the angle signal ring; or the first rotor or the second rotor is formed by a plurality of magnets, magnetic field strengths of the magnets are different from each other, and correspondingly, the stator is a magnet-sensitive device; or the first rotor or the second rotor includes a light source and a baffle mounted below the light source, the baffle is provided with a notch, and correspondingly, the stator is formed by a plurality of light receivers.

A smart center shaft is also provided, including a center shaft body, a main control module and the sensor described above. The center shaft body includes a core and a number of connecting rods disposed at intervals on the core, the stator is fixedly mounted on the center shaft body, the main control module is mounted in the core, and the main control module is electrically connected to the sensor.

When using the smart center shaft, the main control module is electrically connected to the sensor and obtains rotation signals of the first magic cube layer and the second magic cube layer through the sensor, so as to further calculate a state signal of the smart magic cube, thereby achieving the intelligence of the smart magic cube.

A smart magic cube is further provided, including a plurality of magic blocks and the smart center shaft described above. The plurality of magic blocks are mounted on the smart center shaft, and spliced together to form a number of magic cube layers, the magic cube layers includes first magic cube layer and second magic cube layer, each of the first magic cube layer and the second magic cube layer is rotatable around an axis of the connecting rod, the first rotor is configured to be rotatable in synchronous with the first magic cube layer, and the second rotor is configured to be rotatable in synchronous with the second magic cube layer.

In the above smart magic cube, the rotation of the first magic cube layer formed by the magic blocks can drive the first rotor to rotate synchronously, and then the main control module acquires the rotation signal of the first magic cube layer according to the relative rotation between the first rotor and the stator. The rotation of the second magic cube layer formed by the magic blocks can drive the second rotor to rotate synchronously, and then the main control module acquires the rotation signal of the second magic cube layer according to the relative rotation between the second rotor and the stator. In this way, the main control module calculates the state signal of the smart magic cube based on the rotation signals of the first magic cube layers and the second magic cube layers, thereby realizing the intelligence of the smart magic cube. The smart magic cube can further achieve networked online magic cube competitions.

In an embodiment, the connecting rod is rotatably mounted on the core with one end of the connecting rod being connected to the first magic cube layer and another end of the connecting rod being connected to the first rotor, and the stator is fixedly mounted on the core; or the connecting rod is fixedly mounted on the core, the stator is fixedly sleeved on the connecting rod, and both the first rotor and the second rotor are rotatably sleeved on the connecting rod.

In an embodiment, the smart magic cube is a three-order pyramid magic cube, the magic cube includes outer corner blocks, inner corner blocks and edge blocks, the connecting rods are fixedly arranged at the core, the outer corner blocks are spliced together to form the first magic cube layer, the first magic cube layer is rotatably mounted at an end of the connecting rod, the inner corner blocks and the edge blocks are spliced together to form the second magic cube layer, the second magic cube layer is rotatably sleeved on the connecting rod, the sensor is positioned in the inner corner blocks, the stator is fixedly sleeved on the connecting rod, the first rotor is connected to the outer corner block, and the second rotor is connected to an inner wall of the inner corner block.

A monitoring method for a smart magic cube is further provided, including:

fixedly mounting a stator of sensor on a smart magic cube, configuring a first rotor of the sensor to rotate in synchronization with a first magic cube layer of the smart magic cube, and configuring a second rotor of the sensor to rotate in synchronization with a second magic cube layer of the smart magic cube;

acquiring, by a main control module, a rotation signal of the first magic cube layer according to relative rotation between the first rotor and the stator;

acquiring, by the main control module, a rotation signal of the second magic cube layer according to relative rotation between the second rotor and the stator; and calculating, by the main control module, a real-time state of the smart magic cube according to the rotation signals of the first magic cube layer and the second magic cube layer.

In the above monitoring method for the smart magic cube, the sensor outputs the rotation signal of the first magic cube layer according to the relative rotation between the first rotor and the stator, and outputs the rotation signal of the second magic cube layer according to the relative rotation between the second rotor and the stator. The main control module calculates the real-time state of the smart magic cube according to the rotation signals of the first magic cube layer and the second magic cube layer, so that the intelligence of the magic cube is realized.

BRIEF DESCRIPTION OF THE DRAWINGS

For a more complete understanding, reference is now made to the following description taken in conjunction with the accompanying Drawings in which.

Figure 1:
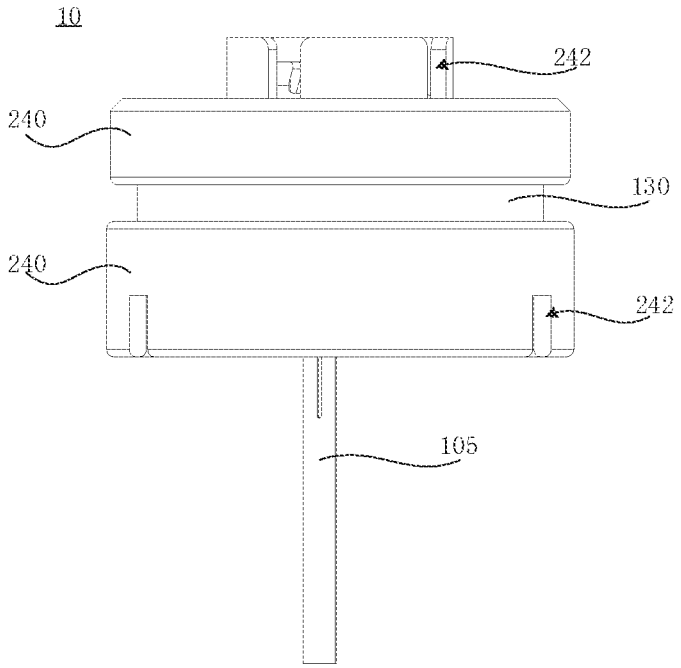
FIG. 1 is a schematic structural diagram illustrating a sensor according to a first embodiment of the present disclosure.

10: sensor; 100: stator; 101: wire connecting ring; 102: sensing ring; 103: common signal ring; 104: angle signal ring; 105: conducting wire; 110: first sensing plate; 111: first sensing surface; 120: second sensing plate; 121: second signal leading-out end; 130; fixing seat; 131: first mounting chamber; 132: second mounting chamber; 140: first sensing portion; 150: second sensing portion; 210: first rotor; 220: second rotor; 230: electrically conductive member; 231: first electrical contact pin; 232: second electrical contact pin; 240: movable seat; 241: accommodating chamber; 242: insertion hole; 243: abutting block; 21: main control module; 22: power supply module; 23: output module; 30: center shaft body; 31: core; 311: sliding groove; 32: connecting rod; 321: first stepped portion; 322: second stepped portion; 323: third stepped portion; 33: screw; 34: elastic member; 41: first magic cube layer; 42: second magic cube layer; 410: outer corner block; 411: insert piece; 420: inner corner block; and 430: edge block.

DETAILED DESCRIPTION

In order to facilitate the understanding of the present disclosure, the present disclosure will be described more fully hereinafter with reference to the related accompanying drawings. Preferable embodiments of the present disclosure are presented in the accompanying drawings. However, the present disclosure may be embodied in many different forms and is not limited to the embodiments described herein. On the contrary, these embodiments are provided to make the understanding of the disclosure of the present disclosure more thorough.

It should be noted that when an element is referred to as being "fixed to" another element, it can be directly fixed to another element or indirectly connected to another element with a mediating element. When an element is considered to be "connected to" another element, it can be directly connected to another element or indirectly connected to another element with a mediating element. Instead, when an element is referred to as being "directly on" another element, there is no intermediate element. The terms "vertical", "horizontal", "left", "right", and the like are used herein for illustrative purposes only. The terms "first", "second" and "third" in the present disclosure do not represent a specific number and order, but are only intended to distinguish names.

With combined reference to FIGS. 4, 5, 8 and 10, a high-order magic cube includes a center shaft body 30 and a plurality of magic blocks mounted on the center shaft body 30. The center shaft body 30 includes a core 31 and a number of connecting rods 32 arranged at intervals on the core 31. Generally, the magic blocks include corner blocks, edge blocks 430, and center blocks. For a three-order pyramid magic cube, there is no center block. Some high-order magic cubes are further provided with intermediate connection blocks. The magic blocks are mounted on the center shaft body 30. The plurality of magic blocks are spliced together to form a number of magic cube layers. For a high-order magic cube (e.g., a regular four-order magic cube, a regular five-order magic cube, or a three-order pyramid magic cube), each connecting rod 32 is provided with at least two magic cube layers, and the at least two magic cube layers are rotatable around an axis of the connecting rod 32. That is, at least a first magic cube layer 41 and a second magic cube layer 42 are arranged on each connecting rod 32.

First Embodiment

Figure 2:
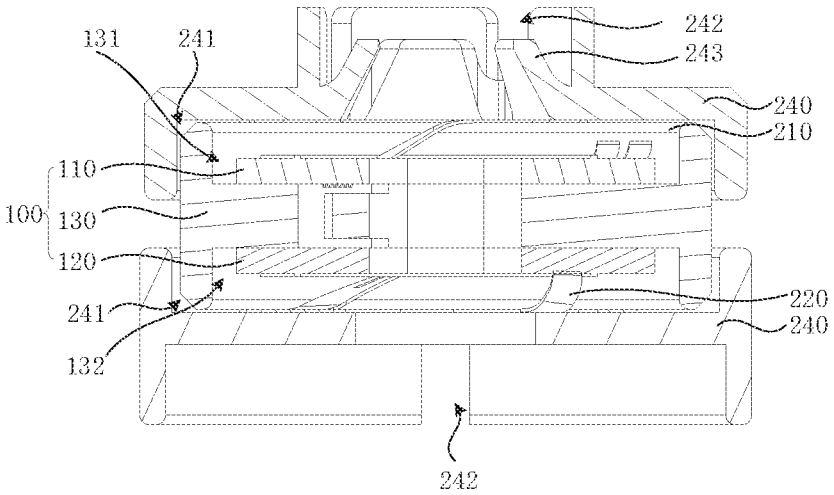
FIG. 2 is an axial cross-sectional view of the sensor shown in FIG. 1.
Figure 3:
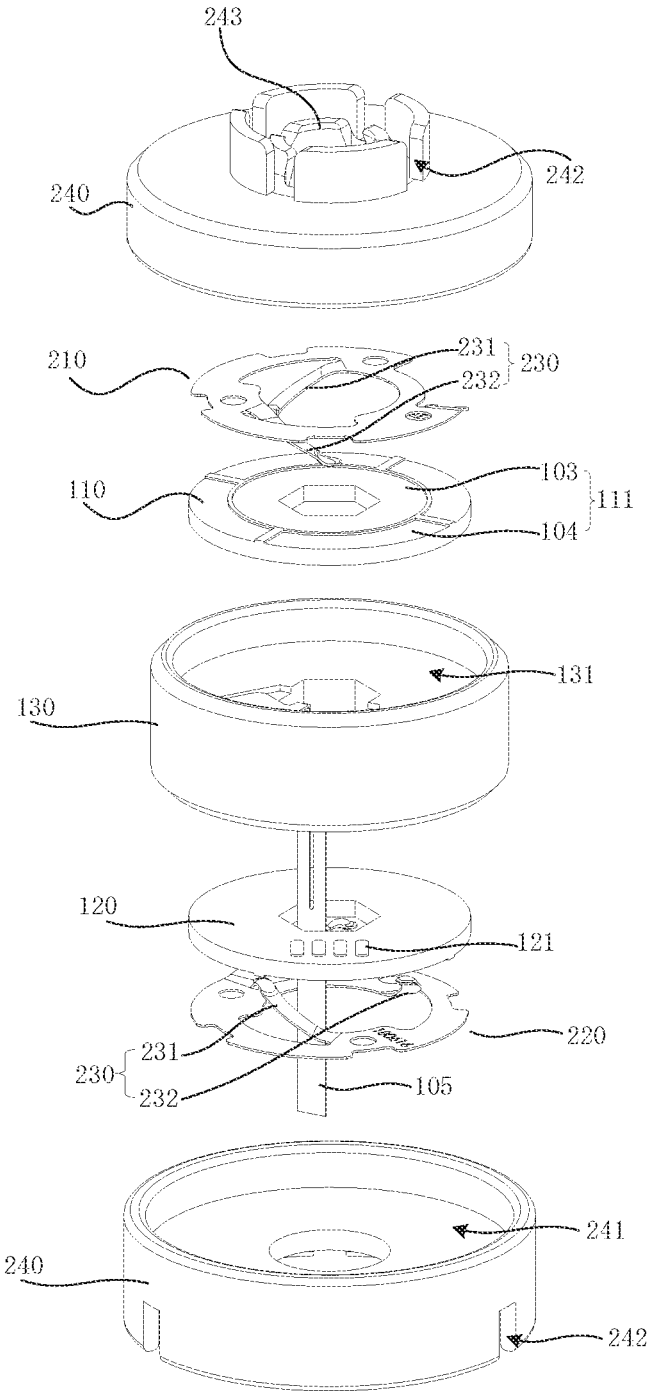
FIG. 3 is an exploded view of the sensor shown in FIG. 1.
Figure 4:
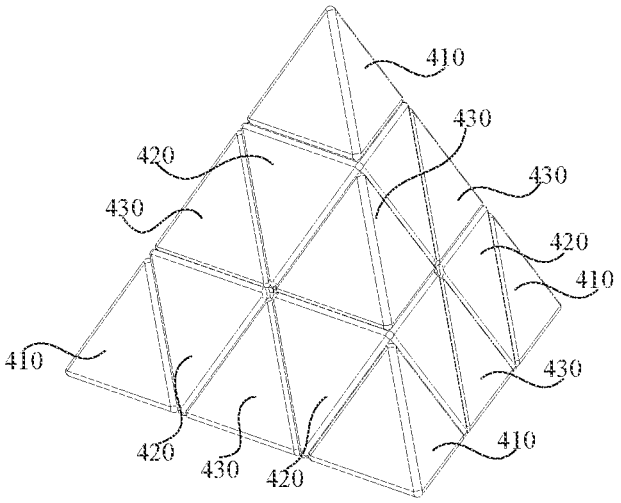
FIG. 4 is a schematic structural diagram illustrating a three-order pyramid magic cube using the sensor shown in FIG. 1.
Figure 9:
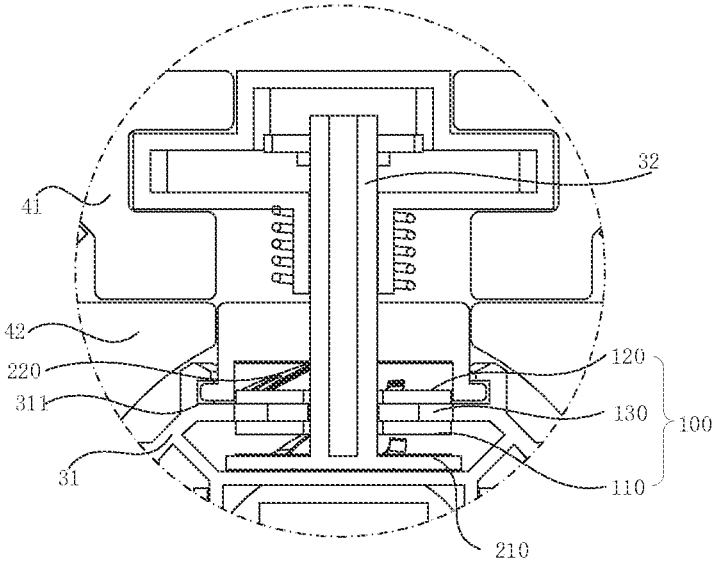
FIG. 9 is an enlarged view of portion A in FIG. 8.
Figure 10:
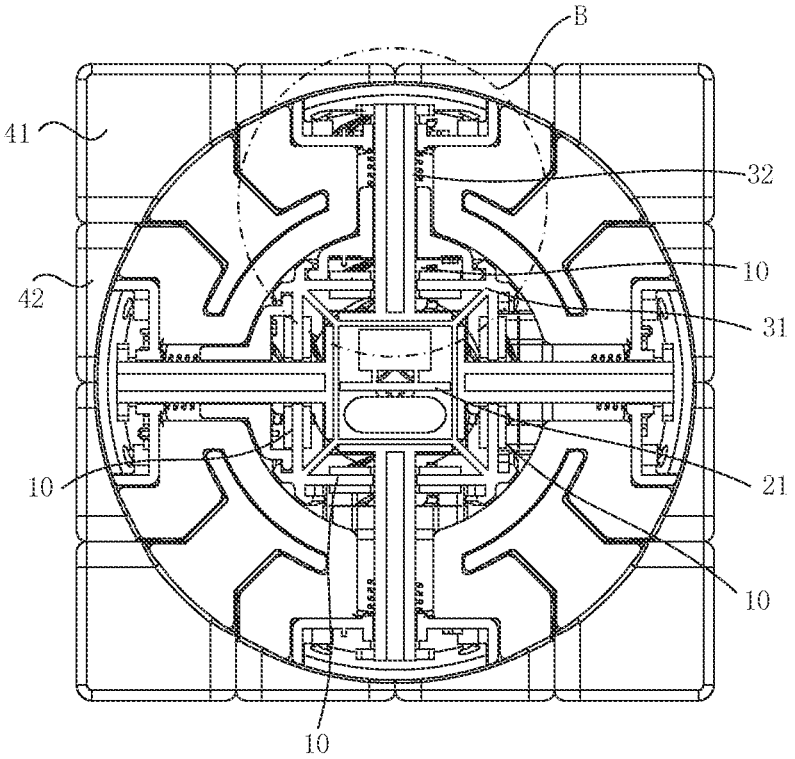
FIG. 10 is an axial cross-sectional view of a regular four-order magic cube using the sensor shown in FIG. 1.
Figure 11:
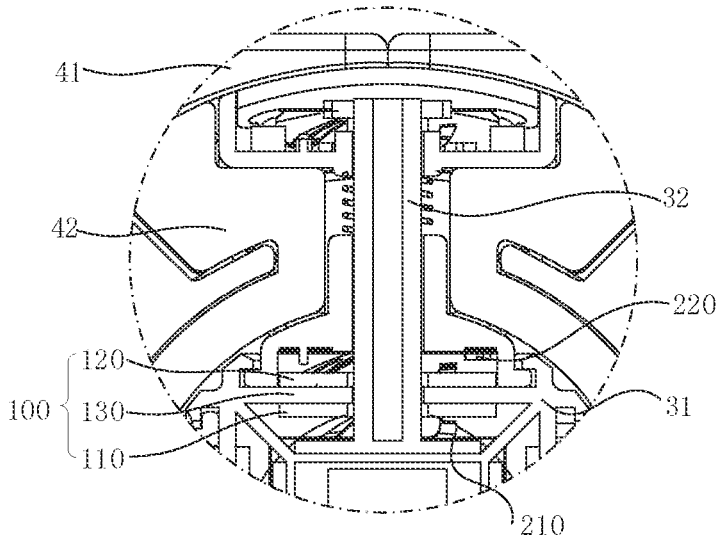
FIG. 11 is an enlarged view of portion B in FIG. 10.

FIG. 1 shows a sensor used by a smart magic cube (hereinafter referred to as a sensor). FIG. 2 is an axial cross-sectional view of the sensor shown in FIG. 1. FIG. 3 is an exploded view of the sensor shown in FIG. 1. With combined reference to FIGS. 1 to 3, the sensor 10 includes a stator 100, a first rotor 210 and a second rotor 220. With combined reference to FIGS. 5, 9 and 11, the stator 100 is configured to be fixedly disposed on the smart magic cube. The first rotor 210 is configured to be rotatable in synchronization with the first magic cube layer 41 of the smart magic cube, such that when the first rotor 210 rotates with the first magic cube layer 41 with respect to the stator 100, the stator 100 or the first rotor 210 can output a rotation signal of the first magic cube layer 41. For example, the stator 100 or the first rotor 210 can output the rotation signal of the first magic cube layer 41 according to a relative rotation amount between the stator 100 and the first rotor 210. The second rotor 220 is configured to be rotatable in synchronization with the second magic cube layer 42 of the smart magic cube, such that when the second rotor 220 rotates with the second magic cube layer 42 with respect to the stator 100, the stator 100 or the second rotor 220 can output a rotation signal of the second magic cube layer 42.

The above sensor 10 can be applied to a smart magic cube. The stator 100 is fixedly disposed so as not to rotate with the rotation of the magic cube layer. The first rotor 210 can rotate with the first magic cube layer 41 with respect to the stator 100, so that the sensor 10 can output the rotation signal of the first magic cube layer 41 according to the relative rotation between the first rotor 210 and the stator 100. The second rotor 220 can rotate with the second magic cube layer 42 with respect to the stator 100, so that the sensor 10 can output the rotation signal of the second magic cube layer 42 according to the relative rotation between the second rotor 220 and the stator 100. In this way, the sensor 10 can detect the rotation signals of the "two magic cube layers" of the smart magic cube by using the structure of "one stator and two rotors", thereby facilitating acquiring a state signal of the smart magic cube in a next step, and realizing the intelligence of the high-order magic cube.

That the stator 100 being configured to be fixedly disposed on the smart magic cube specifically refers to that, the stator 100 is fixedly mounted on a fixing structure of the smart magic cube. The fixing structure of the smart magic cube includes a core 31 and a structural member which is stationary relative to the core 31, and the fixing structure does not rotate in synchronous with the rotation of the magic cube layers.

The rotation signal of the first magic cube layer 41 refers to position information of the first magic cube layer 41 after rotation, or a rotation direction and a rotation angle of the first magic cube layer 41 (which can also be combined with the initial position to obtain the position information of the first magic cube layer 41 after rotation). Similarly, the rotation signal of the second magic cube layer 42 refers to position information of the second magic cube layer 42 after rotation, or a rotation direction and a rotation angle of the second magic cube layer 42.

There is a variety of specific configurations of the sensor 10.

For example, with combined reference to FIGS. 2 and 3, the first rotor 210 or the second rotor 220 is an electrically conductive member 230. The electrically conductive member 230 includes a first electrical contact pin 231 and a second electrical contact pin 232. Accordingly, the stator 100 is provided with a common signal ring 103 and an angle signal ring 104 insulated from the common signal ring 103. Optionally, the common signal ring 103 and the angle signal ring 104 are coaxial. The first electrical contact pin 231 is configured to be in contact with the common signal ring 103, and the second electrical contact pin 232 is configured to be contact with different positions of the angle signal ring 104. When the first magic cube layer 41 or the second magic cube layer 42 rotates, the first electrical contact pin 231 is always pressed against the common signal ring 103 and remains sliding contact with the common signal ring 103. The second electrical contact pin 232 is always pressed against the angle signal ring 104 and remains sliding contact with the angle signal ring 104. A change in the position of the electrically conductive member 230 causes the connection relationship between the common signal ring 103 and the angle signal ring 104 to change, so that different signals, that is, rotation signals of the first magic cube layer 41 or the second magic cube layer 42, can be generated.

Further, the angle signal ring 104 includes a number of sub-electrodes disposed circumferentially at intervals. The stator 100 further includes a resistor assembly. The common signal ring 103, the angle signal ring 104, and the resistor assembly cooperate to form several acquisition paths with different resistances. There is a one-to-one correspondence between the acquisition paths and the sub-electrodes. Each of the acquisition paths is connected with a resistor, a sub-electrode, and a common signal ring 103. The rotation of the electrically conductive member 230 turns on different sub-electrodes and common signal rings 103, thereby turning on different acquisition paths. The rotation signal of the first magic cube layer 41 is acquired according to the different resistances of the acquisition paths.

For example, the first rotor or the second rotor is formed by a plurality of magnets with magnetic field strengths different from each other. Accordingly, the stator is a magnet-sensitive device. The magnet-sensitive device may optionally be a Hall sensor, a magnet-sensitive diode, a magnet-sensitive transistor, a magnet-sensitive resistor, an application-specific integrated circuit, or the like. When the first magic cube layer or the second magic cube layer rotates and the magnet-sensitive device passes by different magnets, different voltages are generated. The rotation signal of the first magic cube layer or the second magic cube layer is acquired according to the different voltages.

For another example, the first rotor or the second rotor includes a light source and a baffle mounted below the light source, the baffle being provided with a notch. Accordingly, the stator is formed by a plurality of light receivers. When the baffle rotates with the first magic cube layer or the second magic cube layer, the notch rotates to be aligned with different light receivers, and the light receivers can receive light from the light source and acquire rotation signals of the first magic cube layer or the second magic cube layer.

Specifically, with continued reference to FIGS. 1 to 3, the stator 100 includes a first sensing plate 110, a second sensing plate 120, and a fixing seat 130. The first sensing plate 110 and the second sensing plate 120 are fixedly mounted on both sides of the fixing seat 130, respectively. The first sensing plate 110 is configured to sense the rotation signal of the first rotor 210 so that the first sensing plate 110 can acquire the rotation signal of the first magic cube layer 41. The second sensing plate 120 is configured to sense the rotation signal of the second rotor 220 so that the second sensing plate 120 can acquire the rotation signal of the second magic cube layer 42.

The first rotor 210, the first sensing plate 110, the fixing seat 130, the second sensing plate 120, and the second rotor 220 are arranged sequentially. The first sensing plate 110 and the second sensing plate 120 are fixedly mounted by the fixing seat 130. The first sensing plate 110 and the second sensing plate 120 cooperate with corresponding rotors, respectively, so that the structure of the entire sensor 10 is more concise and orderly. Optionally, each of the first sensing plate 110 and the second sensing plate 120 may be a circuit board, and the circuit board may be wired according to actual requirements without leading out multiple signal wires, so that errors of wiring and assembly are reduced, thereby making the sensor 10 simple in circuit and simple and compact in structure, and also facilitating achieving mass production for the sensor 10.

Further, referring to FIGS. 1 to 3, the first sensing plate 110 is provided with a first signal leading-out end on a side close to the fixing seat 130, the first sensing plate 110 is provided with a first sensing surface 111 on a side far from the fixing seat 130, and the first sensing surface 111 is configured to sense a rotation signal of the first rotor 210; and/or the second sensing plate 120 is provided with a second signal leading-out end 121 on a side close to the fixing seat 130, the second sensing plate 120 is provided with a second sensing surface on a side far from the fixing seat 130, and the second sensing surface is configured to sense a rotation signal of the second rotor 220.

The first signal leading-out end and the second signal leading-out end 121 are respectively connected to a conducting wire 105, to transmit rotation signals of the first magic cube layer 41 and the second magic cube layer 42 to a main control module 21. Compared to the case where the first sensing surface 111 and the first signal leading-out end are positioned on a same side of the first sensing plate 110, in this embodiment, the first sensing surface 111 and the first signal leading-out end are positioned on different sides of the first sensing plate 110, so that the positions of the regions of both sides of the first sensing plate 110 are fully utilized, the volume of the first sensing plate 110 can be designed to be smaller, and accordingly, the first rotor 210 rotatably cooperates with the first sensing plate 110 and the entire sensor 10 can be designed to be smaller. Similarly, the volume of the second sensing plate 120 can be designed to be smaller.

In addition, since the first sensing plate 110 is compact, the circumference thereof is shortened, and the cooperating area between the first rotor 210 and the first sensing surface 111 is also reduced, thereby reducing damage to the first rotor 210 and easily reducing the weight and inertia of the first sensing plate 110. For example, when the first rotor 210 is an electrically conductive member 230 including the first electrical contact pin 231 and the second electrical contact pin 232, the first sensing surface 111 includes the common signal ring 103 and the angle signal ring 104 located at an outer edge of the common signal ring 103. Since the diameter of the first sensing surface 111 is reduced, the lengths of the rotation paths of the first electrical contact pin 231 and the second electrical contact pin 232 are reduced, and the wear amount of the first rotor 210 is greatly reduced, thereby improving the service life of the stator 100 and the first rotor 210, and improving the service life and reliability of the sensor 10. Similarly, the second sensing plate 120 being compact is conducive to reduce the wear amount of the second rotor 220.

Further, referring to FIGS. 2 and 3, the fixing seat 130 is provided with a first mounting chamber 131 for mounting and fixing the first sensing plate 110; and/or the fixing seat 130 is provided with a second mounting chamber 132 for mounting and fixing the second sensing plate 120. The arrangement of the first mounting chamber 131 and the second mounting chamber 132 can prevent the first sensing plate 110 and the second sensing plate 120 from being disturbed by the environment or other components, especially in the smart magic cube with narrow internal space and a large number of components which are constantly rotating when used.

Figure 5:
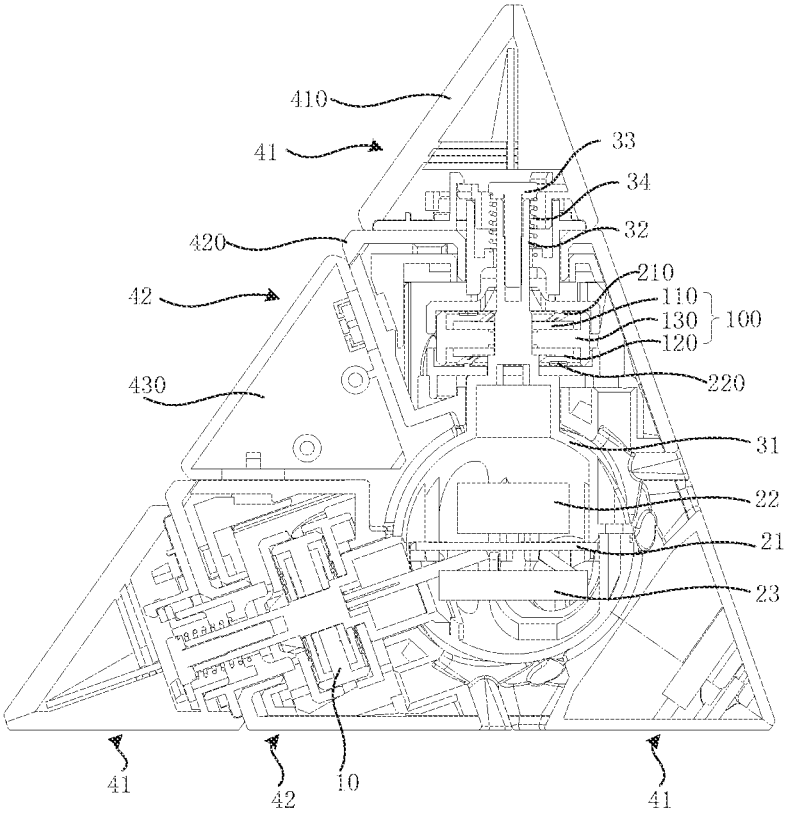
FIG. 5 is an axial cross-sectional view of the three-order pyramid magic cube shown in FIG. 4.

Specifically, with combined reference to FIGS. 2, 3 and 5, the sensor 10 further includes a movable seat 240. The movable seat 240 is provided with an accommodating chamber 241 on a side towards the stator 100. When the movable seat 240 is configured to be connected to the first magic cube layer 41, the first rotor 210 is fixedly mounted in the accommodating chamber 241 so that the first rotor 210 rotates in synchronous with the first magic cube layer 41 through the movable seat 240. When the movable seat 240 is configured to be connected to the second magic cube layer 42, the second rotor 220 is fixedly mounted in the accommodating chamber 241 so that the second rotor 220 rotates in synchronous with the second magic cube layer 42 through the movable seat 240. The arrangement of the accommodating chamber 241 can prevent the first rotor 210 and the second rotor 220 from being disturbed, shaken, and impacted by the environment or other components, especially in the smart magic cube with narrow internal space and a large number of components which are constantly rotating when used, and can improve the reliability and accuracy of the detection by cooperation between the first rotor 210, the second rotor 220, and the stator 100.

By converting the design of the accuracy of the relative position of the first rotor 210 or the second rotor 220 with respect to the stator 100 into the design of the accuracy of the relative position of the movable seat 240 with respect to the fixing seat 130, it is easier to design and ensure the accuracy, and is more technically easy to implement and control. Optionally, the first rotor 210, the second rotor 220, and the movable seat 240 are fixedly connected by means of clamping, bonding, or integrally molding.

Specifically, the movable seat 240 and the fixing seat 130 are sleeve-connected to each other. For example, referring to FIG. 2, the movable seat 240 is sleeve-connected to the fixing seat 130 so that the first rotor 210 and the second rotor 220 rotatably cooperate with the stator 100 in a relatively closed chamber to avoid external interference.

Second Embodiment

The second embodiment differs from the first embodiment in that the specific configuration of the stator 100 is different.

Figure 12:
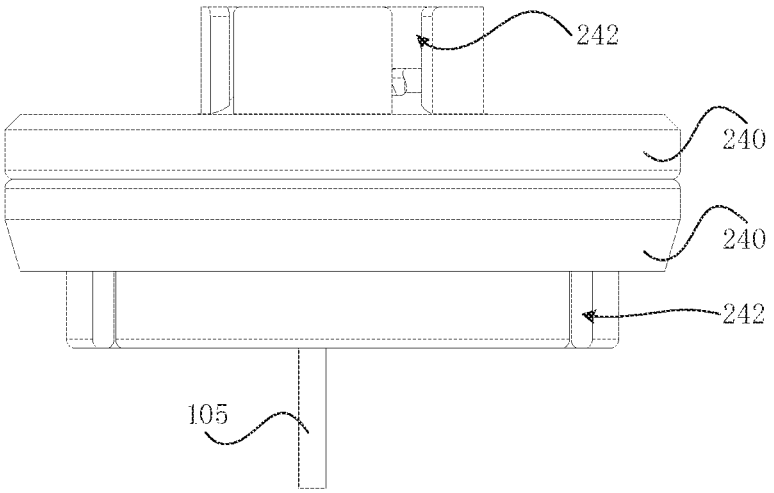
FIG. 12 is a schematic structural diagram illustrating a sensor according to a second embodiment of the present disclosure.
Figure 13:
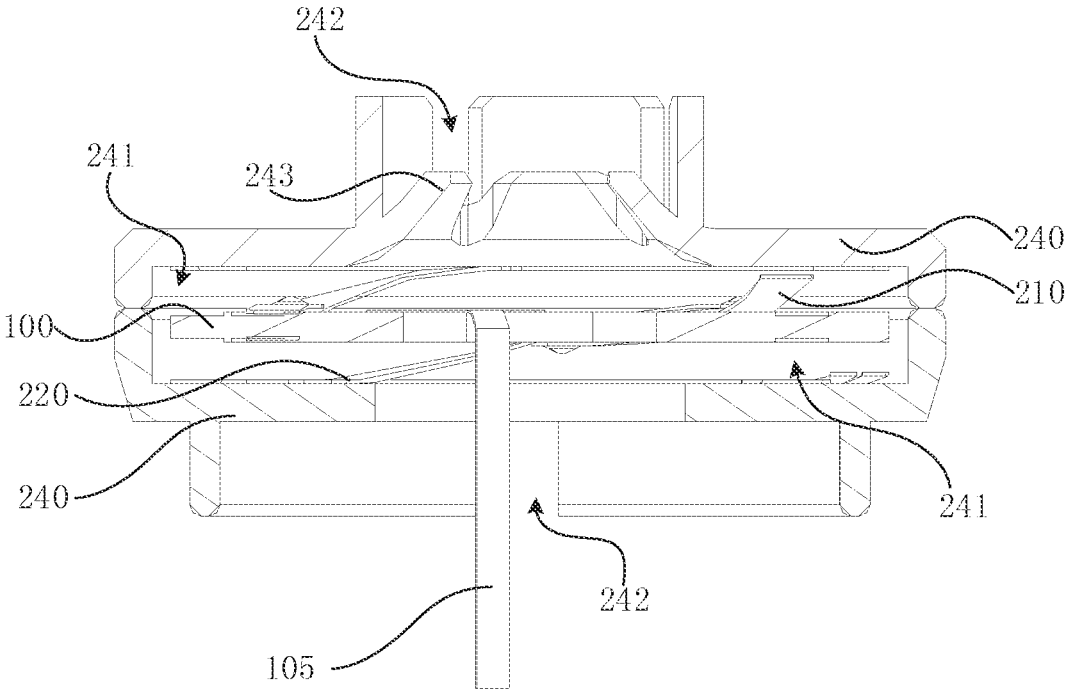
FIG. 13 is an axial cross-sectional view of the sensor shown in FIG. 4.
Figure 14:
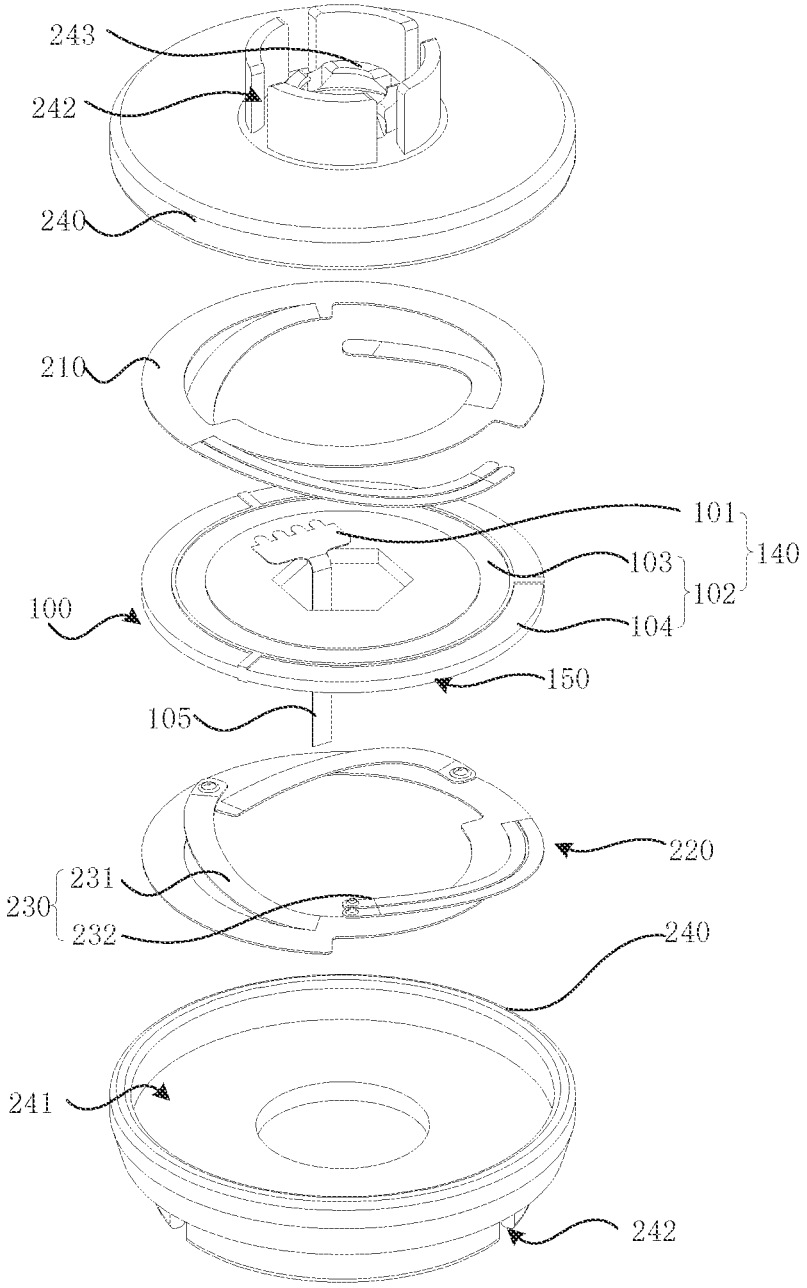
FIG. 14 is an exploded view of the sensor shown in FIG. 4.

In this embodiment, referring to FIGS. 12 to 14, one side of the stator 100 is provided with a first sensing portion 140 configured to sense a rotation signal of the first rotor 210, and the other side of the stator 100 is provided with a second sensing portion 150 configured to sense a rotation signal of the second rotor 220. The first rotor 210 cooperates with the first sensing portion 140 to output a rotation signal of the first magic cube layer 41. The second rotor 220 cooperates with the second sensing portion 150 to output a rotation signal of the second magic cube layer 42.

Specifically, the first sensing portion 140 and/or the second sensing portion 150 include a wire connecting ring 101 and a sensing ring 102. The sensing ring 102 is configured to sense a rotation signal of the first rotor 210 or the second rotor 220. The wire connecting ring 101 is provided with a wire connecting end configured to output the rotation signal. The wire connecting ring 101 can be electrically connected to the main control module 21 located in the core 31 via the conducting wire 105 so as to transmit rotation signals of the first magic cube layer 41 and the second magic cube layer 42 to the main control module 21.

With combined reference to FIG. 14, the first rotor 210 and the second rotor 220 may optionally be the electrically conductive member 230 including the first electrical contact pin 231 and the second electrical contact pin 232, and the sensing ring 102 includes the common signal ring 103 and the angle signal ring 104 positioned at an outer edge of the common signal ring 103, so that the electrically conductive member 230 is in contact with and rotatably cooperates with the common signal ring 103 and the angle signal ring 104, respectively, to generate the rotation signal.

Optionally, the stator 100 may be constructed in the form of a PCB board to facilitate manufacturing. The wire connecting ring 101 is located at the inner side of the sensing ring 102, or the sensing ring 102 is located at the inner side of the wire connecting ring 101.

It can be understood that in other embodiments, the first sensing portion and/or the second sensing portion include a wire connecting layer and a sensing layer, the sensing layer is configured to sense a rotation signal of the first rotor or the second rotor, and the wire connecting layer is provided with a wire connecting end configured to output the rotation signal. The wire connecting layer and the sensing layer are distributed along the thickness direction of the stator, thereby reducing the surface areas of the first sensing portion and the second sensing portion, reducing the lengths of the rotation paths of the first rotor and the second rotor, and reducing the loss of the sensor.

Third Embodiment

Referring to FIGS. 5, 8, 10, and 15, a smart center shaft includes a center shaft body 30, a main control module 21, and the above-described sensors 10. The center shaft body 30 includes a core 31 and a plurality of connecting rods 32 arranged at intervals on the core 31. The stators 100 are fixedly mounted on the center shaft body 30, the main control module 21 is mounted in the core 31, and the main control module 21 is electrically connected to the sensors 10.

When using the smart center shaft, the main control module 21 is electrically connected to the sensors 10 and obtains rotation signals of the first magic cube layers 41 and the second magic cube layers 42 through the sensors 10, so as to further calculate state signals of the smart magic cube, thereby achieving the intelligence of the smart magic cube. The state signal is configured to characterize the relative positional relationship between the magic blocks in the smart magic cube.

In addition, the smart magic cube can further realize networked online magic cube competition, and the state of the smart magic cube can be synchronized to the electronic device of the user in real time, and further realize other interactive functions, such as a teaching video of making the magic cube, a synchronous competition in different places, and the like, through a peripheral device.

Specifically, with combined reference to FIG. 5, the main control module 21 includes a processing unit, a control unit, and a communication unit. The processing unit is configured to convert the rotation signals of the first magic cube layers 41 and the second magic cube layers 42 into state signals of the smart magic cube. The control unit is electrically connected to the processing unit and the communication unit, respectively. The communication unit may optionally be a wireless communication unit, such as a Bluetooth unit, a Wi-Fi unit, a 2.4 G unit, or an NFC unit. The communication unit is configured to transmit data between the control unit and a peripheral equipment, so as to realize networked communication, networked teaching, networked training, or networked competition, and more specifically, to realize real-time synchronous control, electronic blind twisting, timing, restoration step reproduction, shortest restoration route prompt, and statistics function of a virtual magic cube. It will be understood that in other embodiments, the main control module 21 may convert the rotation signals of the first magic cube layers 41 and the second magic cube layers 42 into state signals of the smart magic cube by means of a peripheral processing device, and the peripheral processing device may then transmit the state signals of the smart magic cube back to the main control module 21, thereby reducing the volume of the main control module 21 and reducing the space of the core 31 occupied by the main control module 21.

Further, referring to FIG. 5, at least one of a power supply module 22, an output module 23, and a movement sensing module is further mounted within the core 31.

The power supply module 22 is electrically connected to the main control module 21. The power supply module 22 is configured to provide power for the main control module 21.

The output module 23 is electrically connected to the main control module 21. The main control module 21 drives the output module 23 to generate a corresponding output mode according to the state signal of the smart magic cube, thereby increasing the interaction between the smart magic cube and the player. For example, the main control module 21 acquires, according to the state signal of the smart magic cube, what situation mode the smart magic cube is in, for example, in a start-up mode, a restoration completion mode, or an alarm mode of insufficient remaining time. The output module 23 may optionally be a light emitting element, a sound emitting element or a vibration element. The light emitting element expresses a specific situation mode with light. The vibration element may optionally be an electromechanical drive element, and the electromechanical drive element expresses a specific situation mode by vibration.

The movement sensing module is electrically connected to the main control module 21. The movement sensing module is configured to turn on or turn off the main control module 21, and to sense an overall movement amount and an overall flip angle of the smart magic cube. Optionally, the movement sensing module is an acceleration sensor, a vibration switch, or a touch switch. When the smart magic cube is picked up by the player, the movement sensing module turns on the main control module 21 so that the main control module 21 starts to operate. When the smart magic cube is put down by the player, the movement sensing module turns off the main control module 21 so that the main control module 21 enters the sleep state. When the movement sensing module is an acceleration sensor, a geomagnetic sensor or a gyroscope, the movement sensing module can sense the overall movement amount and the overall flip angle of the smart magic cube, and further sense the real-time spatial posture of the smart magic cube, so that the player can view the real-time spatial posture of the smart magic cube from one same viewing angle through the display.

Specifically, with combined reference to FIGS. 2, 3, 5, and 6, the connecting rod 32 is provided with a first stepped portion 321, the sensor 10 is located between the first step portion 321 and the core 31, and an abutting block 243 is provided on one side of the movable seat 240 close to the first stepped portion 321, the abutting block 243 can abut against the first stepped portion 321, thereby preventing the sensor 10 from moving upward in the axial direction of the connecting rod 32, thereby ensuring the measurement accuracy of the sensor 10.

The abutting block 243 is arranged obliquely, and a gap exists between the abutting block 243 and the rod structure of the connecting rod 32 to avoid friction between the abutting block 243 and the rod structure of the connecting rod 32, thereby increasing the service life of the sensor 10 and the connecting rod 32.

Figure 6:
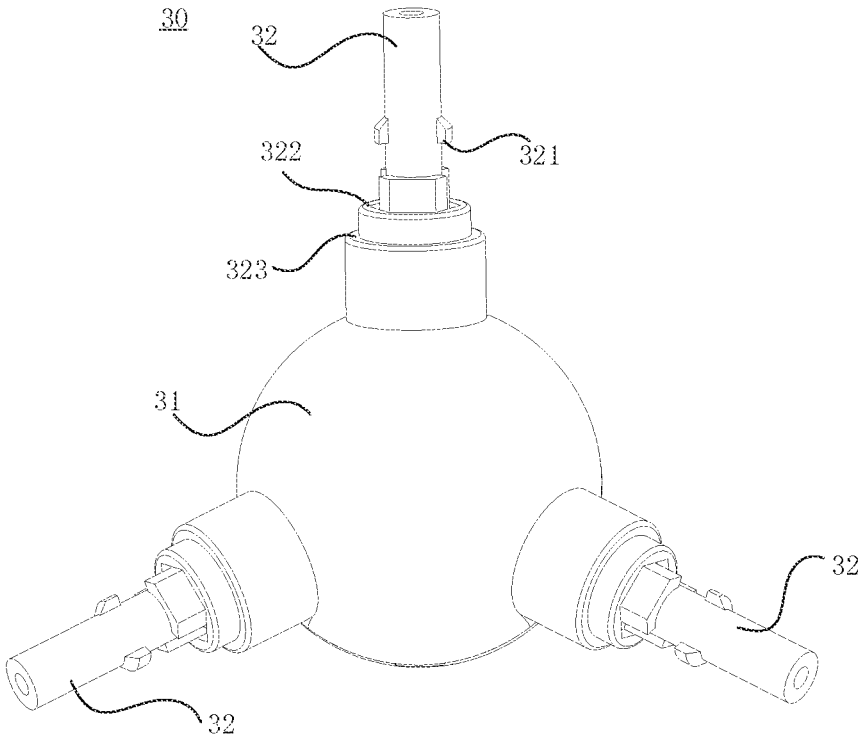
FIG. 6 is a schematic structural diagram illustrating a center shaft body of the three-order pyramid magic cube shown in FIG. 5.

Specifically, referring to FIG. 6, the connecting rod 32 is further provided with a second stepped portion 322, and the second stepped portion 322 is located between the first stepped portion 321 and the core 31. The stator 100 is fixedly sleeved on the connecting rod 32, and the bottom of the stator 100 abuts against the second stepped portion 322 to prevent the stator 100 from moving downward in the axial direction of the connecting rod 32.

Specifically, referring to FIG. 6, the connecting rod 32 is further provided with a third stepped portion 323, and the third stepped portion 323 is located between the second stepped portion 322 and the core 31. One of the first rotor 210 and the second rotor 220 away from the first stepped portion 321 abuts against the third stepped portion 323 to prevent the sensor 10 from moving downwardly in the axial direction of the connecting rod 32.

Specifically, the movable seat 240 is provided with a flange on a side near the stator 100, and the core 31 (see FIGS. 9 and 11) or the fixing seat 130 is provided with a corresponding sliding groove 311. By cooperation between the flange and the sliding groove 311, the first rotor 210 or the second rotor 220 is rotatable stably without moving along the axis of the connecting rod 32.

Fourth Embodiment

With reference to FIGS. 5, 8, 10, and 15, a smart magic cube includes a plurality of magic blocks and the above-described smart center shaft. The plurality of magic blocks are mounted on the smart center shaft, and the plurality of magic blocks are spliced together to form a number of magic cube layers. The magic cube layers includes first magic cube layers 41 and second magic cube layers 42. The first magic cube layers 41 and the second magic cube layers 42 are rotatable around the axes of the connecting rods 32. The first rotors 210 are configured to be rotatable in synchronous with the first magic cube layers 41, and the second rotors 220 are configured to be rotatable in synchronous with the second magic cube layers 42.

In the above smart magic cube, the rotation of the first magic cube layer 41 formed by magic blocks can drive the first rotor 210 to rotate synchronously, and then the main control module 21 acquires the rotation signal of the first magic cube layer 41 according to the relative rotation between the first rotor 210 and the stator 100. The rotation of the second magic cube layer 42 formed by magic blocks can drive the second rotor 220 to rotate synchronously, and then the main control module 21 acquires the rotation signal of the second magic cube layer 42 according to the relative rotation between the second rotor 220 and the stator 100. In this way, the main control module 21 calculates the state signals of the smart magic cube based on the rotation signals of the first magic cube layers 41 and the second magic cube layers 42, thereby realizing the intelligence of the smart magic cube. The smart magic cube can further achieve networked online magic cube competitions.

In an embodiment, with combined reference to FIGS. 8 to 11, the connecting rod 32 is rotatably mounted on the core 31 with one end of the connecting rod 32 being connected to the first magic cube layer 41 and another end of the connecting rod 32 being connected to the first rotor 210. The stator 100 is fixedly mounted on the core 31. The second rotor 220 is connected to the second magic cube layer 42. In this way, the rotation of the first magic cube layer 41 drives the connecting rod 32 and the first rotor 210 to rotate synchronously, so that the sensor 10 can generate the rotation signal of the first magic cube layer 41 according to the relative rotation between the first rotor 210 and the stator 100.

Specifically, one of the periphery of the movable seat 240 and the outer surface of the core 31 is provided with a flange, and the other one of the periphery of the movable seat 240 and the outer surface of the core 31 is provided with a sliding groove 311 slidably cooperates with the flange. In this way, during the rotation of the first rotor 210 or the second rotor 220, the sliding groove 311 can limit the movable seat 240, ensure the rotation of the first rotor 210 or the second rotor 220 to be stable, and improve the detection stability and accuracy of the sensor 10.

Figure 15:
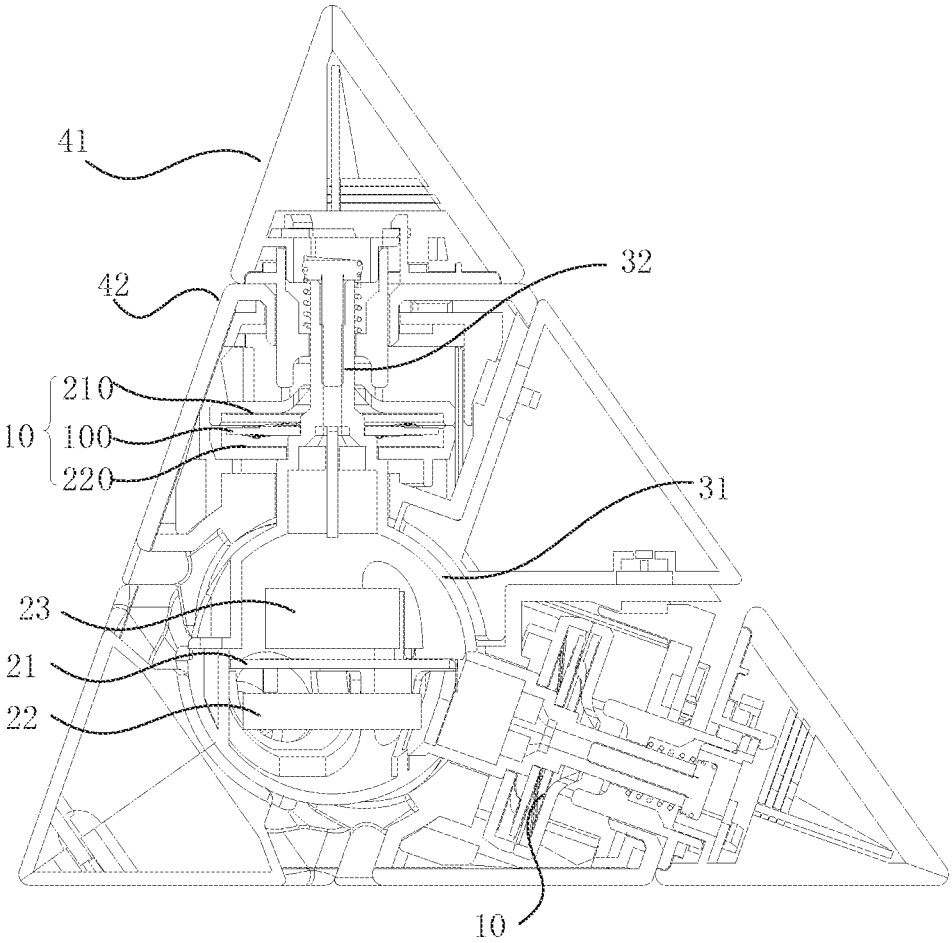
FIG. 15 is a schematic structural diagram illustrating a three-order pyramid magic cube using the sensor shown in FIG. 12.

In another embodiment, with combined reference to FIGS. 5 and 15, the connecting rod 32 is fixedly mounted on the core 31. The stator 100 is fixedly sleeved on the connecting rod 32 so as to facilitate quick assembly and disassembly between the stator 100 and the connecting rod 32. Both the first rotor 210 and the second rotor 220 are rotatably sleeved on the connecting rod 32. In this way, the first rotor 210 and the second rotor 220 will not be flicked during rotating in synchronous with the first magic cube layer 41 and the second magic cube layer 42, thereby improving the stability of use and the accuracy of detection.

The connecting rod 32 is a hollow rod, and the inside of the hollow rod communicates with the inside of the core 31. The stator 100 is connected to a conducting wire 105, and the conducting wire 105 passes through the hollow rod and is electrically connected to the main control module 21 located at the core 31. In this way, the stator 100 transmits the rotation signals of the first magic cube layer 41 and the second magic cube layer 42 to the main control module 21 via the conducting wire 105.

Specifically, with combined reference to FIGS. 5 and 15, the smart magic cube is a three-order pyramid magic cube, and the magic blocks include outer corner blocks 410, inner corner blocks 420, and edge blocks 430. The center shaft body 30 is provided with four connecting rods 32. The inner corner block 420 is rotatably mounted at the middle of each of the connecting rods 32, and the outer corner block 410 is rotatably mounted at the end of each of the connecting rods 32. The bottom of the inner corner block 420 is provided with a concave surface in which three slideways are provided. The edge block 430 is interposed between two adjacent inner corner blocks 420. For example, the bottom of the edge block 430 is provided with two clamping foots, and the two clamping foots are respectively clamped in the slideways of the two adjacent inner corner blocks 420 so that the edge block 430 can rotate in synchronous with either of the inner corner blocks 420 adjacent to the edge block 430.

In the three-order pyramid magic cube, the connecting rods 32 are fixedly arranged at the core 31. The outer corner blocks 410 form the first magic cube layers 41, and the first magic cube layers 41 are rotatably mounted on the ends of the connecting rods 32. The inner corner blocks 420 and the edge blocks 430 form the second magic cube layers 42, and the second magic cube layers 42 are rotatably sleeved on the connecting rods 32. The sensors 10 are positioned in the inner corner blocks 420, the stators 100 are fixedly sleeved on the connecting rods 32, the first rotors 210 are connected to the outer corner blocks 410, and the second rotors 220 are connected to the inner walls of the inner corner blocks 420. In this manner, the sensors 10 are positioned inside the inner corner blocks 420, thus can be prevented from being influenced by factors such as vibration and impact, thereby improving the operational reliability of the sensors 10.

In addition, in the three-order pyramid magic cube, the chamber of the inner corner block 420 is larger than the chamber of the outer corner block 410, thereby facilitating the installation of the sensors 10.

Referring to FIG. 5, the three-order pyramid magic cube further includes screws 33 and elastic members 34. An end of the connecting rod 32 is provided with a screw hole that matches with the screw 33. One end of the elastic member 34 abuts against the end of the screw 33, and another end of the elastic member 34 abuts against the inner wall of the outer corner block 410. Optionally, the elastic member 34 is a spring or a rubber pad. The elastic member 34 applies an elastic force to the outer corner block 410 such that the entire three-order pyramid magic cube has a certain tension. The screw 33 is inserted into the screw hole in an adjustable position, that is, the tension is adjustable so as to satisfy the hand feeling of the player.

Figure 7:
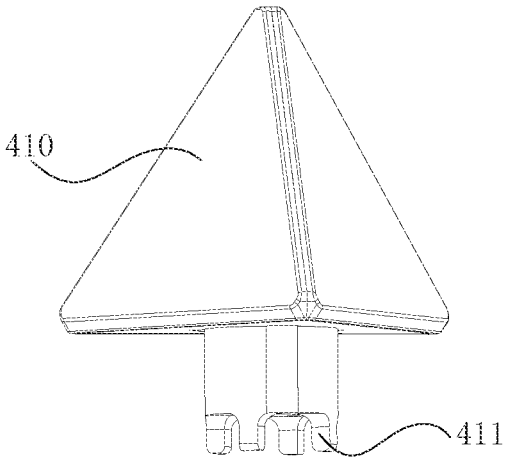
FIG. 7 is a schematic structural diagram illustrating an outer corner block of the three-order pyramid magic cube shown in FIG. 5.
Figure 8:
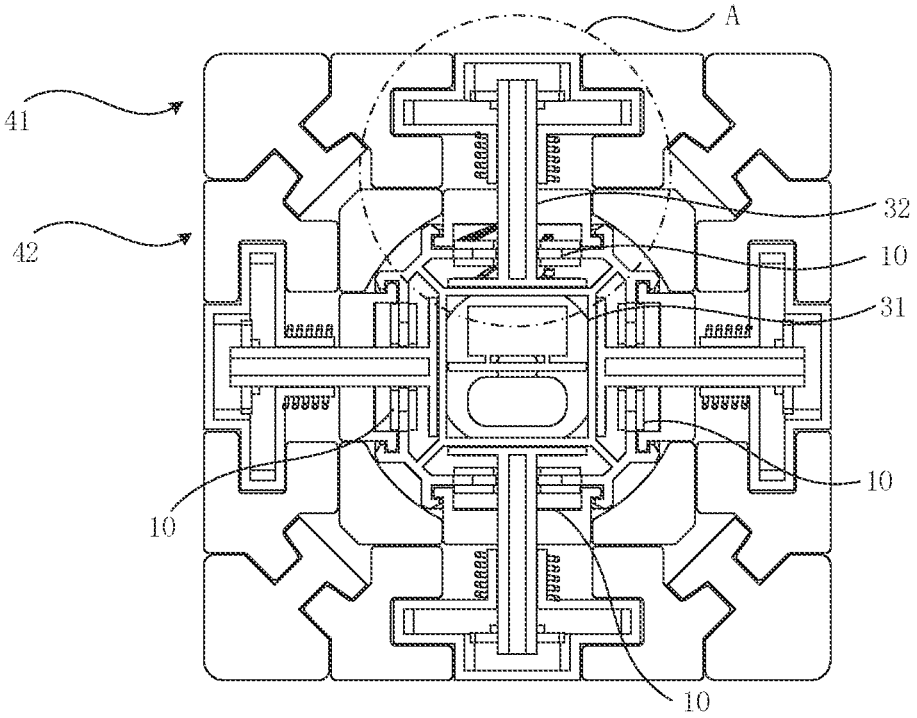
FIG. 8 is an axial cross-sectional view of a regular five-order magic cube using the sensor shown in FIG. 1.

The first rotor 210 can be connected to the outer corner block 410 in many ways. For example, with combined reference to FIGS. 5 to 7, a part of the structure of the outer corner block 410 extends into the inner corner block 420.

One of the outer corner block 410 and the first rotor 210 is provided with an insertion hole 242, and the other one of the outer corner block 410 and the first rotor 210 is provided with an insert piece 411 matching the insertion hole 242. Specifically, the outer corner block 410 is provided with an insert piece 411, and the movable seat 240 for mounting the first rotor 210 is provided with an insert piece 411. In this way, the first rotor 210 and the outer corner block 410 can rotate synchronously by means of insertion, so that disassembly and assembly are facilitated without screws. It will be appreciated that in other embodiments, synchronous rotation may also be achieved between the first rotor 210 and the outer corner block 410 by means of snap joint, adhesive joint, abutting joint or sleeve joint.

Similarly, the second rotor 210 can be connected to the inner wall of the inner corner block 410 in many ways. For example, one of the inner walls of the inner corner block and the second rotor is provided with an insertion hole, and the other one of the inner walls of the inner corner block and the second rotor is provided with an insert piece matching the insertion hole. Optionally, the second rotor is mounted in the movable seat, and the movable seat is provided with an insertion hole.

Fifth Embodiment

Figure 16:
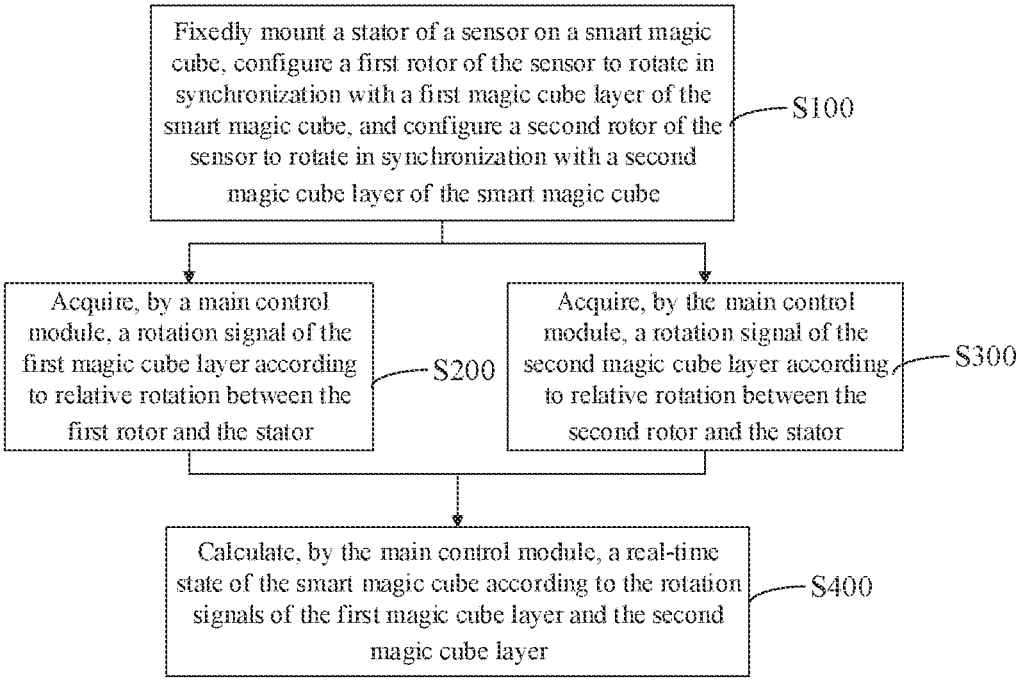
FIG. 16 is a flow diagram illustrating a monitoring method for the smart magic cube according to a fifth embodiment of the present disclosure.

Referring to FIG. 16, a monitoring method for a smart magic cube includes the following steps.

At S100, referring to FIGS. 1 to 5, the stator 100 of the sensor 10 is fixedly mounted on the smart magic cube, the first rotor 210 of the sensor 10 is configured to rotate in synchronization with the first magic cube layers 41 of the smart magic cube, and the second rotor 220 of the sensor 10 is configured to rotate in synchronization with the second magic cube layers 42 of the smart magic cube.

At S200, the main control module 21 acquires a rotation signal of the first magic cube layer 41 according to relative rotation between the first rotor 210 and the stator 100.

At S300, the main control module 21 acquires a rotation signal of the second magic cube layer 42 according to the relative rotation between the second rotor 220 and the stator 100.

At S400, the main control module 21 calculates a real-time state of the smart magic cube according to the rotation signals of the first magic cube layer 41 and the second magic cube layer 42.

In the above monitoring method for the smart magic cube, the sensor 10 outputs the rotation signal of the first magic cube layer 41 according to the relative rotation between the first rotor 210 and the stator 100, and outputs the rotation signal of the second magic cube layer 42 according to the relative rotation between the second rotor 220 and the stator 100. The main control module 21 calculates the real-time state of the smart magic cube according to the rotation signals of the first magic cube layer 41 and the second magic cube layer 42, so that the intelligence of the magic cube is realized.

Optionally, the sensor used in the monitoring method is any of the sensors mentioned in the embodiments.

Each of the technical features of the above-mentioned embodiments may be combined arbitrarily. To simplify the description, not all the possible combinations of each of the technical features in the above embodiments are described. However, all of the combinations of these technical features should be considered as within the scope of this disclosure, as long as such combinations do not contradict with each other.

The above-mentioned embodiments are merely illustrative of several embodiments of the present disclosure, which are described specifically and in detail, but it cannot be understood to limit the scope of the present disclosure. It should be noted that, for those ordinary skilled in the art, several variations and improvements may be made without departing from the concept of the present disclosure, and all of which are within the protection scope of the present disclosure. Therefore, the protection scope of the present disclosure shall be defined by the appended claims.

What is claimed is:

1. A sensor used by a smart magic cube, the sensor comprising:

a stator, configured to be fixedly disposed on the smart magic cube;

a first rotor, configured to be rotatable in synchronization with a first magic cube layer of the smart magic cube, such that when the first rotor rotates with the first magic cube layer with respect to the stator, the stator or the first rotor is capable of outputting a rotation signal of the first magic cube layer; and a second rotor, configured to be rotatable in synchronization with a second magic cube layer of the smart magic cube, such that when the second rotor rotates with the second magic cube layer with respect to the stator, the stator or the second rotor is capable of outputting a rotation signal of the second magic cube layer;

wherein the stator includes a first sensing plate, a second sensing plate, and a fixing seat, and the first sensing plate and the second sensing plate are fixedly mounted on both sides of the fixing seat, respectively, and wherein the first sensing plate is configured to sense a rotation signal of the first rotor, and the second sensing plate is configured to sense a rotation signal of the second rotor.

2. The sensor according to claim 1, wherein the first sensing plate is provided with a first signal leading-out end on a side close to the fixing seat, the first sensing plate is provided with a first sensing surface on a side far from the fixing seat, and the first sensing surface is configured to sense the rotation signal of the first rotor; and/or the second sensing plate is provided with a second signal leading-out end on a side close to the fixing seat, the second sensing plate is provided with a second sensing surface on a side far from the fixing seat, and the second sensing surface is configured to sense the rotation signal of the second rotor.

3. The sensor according to claim 1, wherein the fixing seat is provided with a first mounting chamber for mounting and fixing the first sensing plate; and/or the fixing seat is provided with a second mounting chamber for mounting and fixing the second sensing plate.

4. The sensor according to claim 1, wherein a side of the stator is provided with a first sensing portion configured to sense a rotation signal of the first rotor, and another side of the stator is provided with a second sensing portion configured to sense a rotation signal of the second rotor.

5. The sensor according to claim 4, wherein the first sensing portion and/or the second sensing portion includes a wire connecting ring and a sensing ring, the sensing ring is configured to sense a rotation signal of the first rotor or the second rotor, and the wire connecting ring is provided with a wire connecting end configured to output the rotation signal; or the first sensing portion and/or the second sensing portion include a wire connecting layer and a sensing layer, the sensing layer is configured to sense a rotation signal of the first rotor or the second rotor, and the wire connecting layer is provided with a wire connecting end configured to output the rotation signal.

6. The sensor according to claim 1, wherein the sensor further includes a movable seat, the movable seat is provided with an accommodating chamber on a side towards the stator; and when the movable seat is configured to be connected to the first magic cube layer, the accommodating chamber is configured to fixedly mount the first rotor, or when the movable seat is configured to be connected to the second magic cube layer, the accommodating chamber is configured to fixedly mount the second rotor.

7. The sensor according to claim 1, wherein:

the first rotor or the second rotor is an electrically conductive member, the electrically conductive member includes a first electrical contact pin and a second electrical contact pin, and correspondingly, the stator is provided with a common signal ring and an angle signal ring insulated from the common signal ring, the first electrical contact pin is configured to contact the common signal ring and the second electrical contact pin is configured to contact different positions of the angle signal ring; or the first rotor or the second rotor is formed by a plurality of magnets, magnetic field strengths of the magnets are different from each other, and correspondingly, the stator is a magnet-sensitive device; or the first rotor or the second rotor includes a light source and a baffle mounted below the light source, the baffle is provided with a notch, and correspondingly, the stator is formed by a plurality of light receivers.

8. A smart center shaft, comprising a center shaft body, a main control module and the sensor according to claim 1, wherein the center shaft body includes a core and a number of connecting rods disposed at intervals on the core, the stator is fixedly mounted on the center shaft body, the main control module is mounted in the core, and the main control module is electrically connected to the sensor.

9. A smart magic cube, comprising a plurality of magic blocks and the smart center shaft according to claim 8, wherein, the plurality of magic blocks are mounted on the smart center shaft, and spliced together to form a number of magic cube layers, the magic cube layers includes the first magic cube layer and the second magic cube layer, each of the first magic cube layer and the second magic cube layer is rotatable around an axis of the connecting rod, the first rotor is configured to be rotatable in synchronous with the first magic cube layer, and the second rotor is configured to be rotatable in synchronous with the second magic cube layer.

10. The smart magic cube according to claim 9, wherein the connecting rod is rotatably mounted on the core with one end of the connecting rod being connected to the first magic cube layer and another end of the connecting rod being connected to the first rotor, and the stator is fixedly mounted on the core; or the connecting rod is fixedly mounted on the core, the stator is fixedly sleeved on the connecting rod, and both the first rotor and the second rotor are rotatably sleeved on the connecting rod.

11. The smart magic cube according to claim 9, wherein the smart magic cube is a three-order pyramid magic cube, the magic blocks includes outer corner blocks, inner corner blocks and edge blocks, the connecting rods are fixedly arranged at the core, the outer corner blocks are spliced together to form the first magic cube layer, the first magic cube layer is rotatably mounted at an end of the connecting rod, the inner corner blocks and the edge blocks are spliced together to form the second magic cube layer, the second magic cube layer is rotatably sleeved on the connecting rod, the sensor is positioned in the inner corner block, the stator is fixedly sleeved on the connecting rod, the first rotor is connected to the outer corner block, and the second rotor is connected to an inner wall of the inner corner block.

12. A monitoring method for a smart magic cube, comprising:

fixedly mounting a stator of a sensor on a smart magic cube, configuring a first rotor of the sensor to rotate in synchronization with a first magic cube layer of the smart magic cube, and configuring a second rotor of the sensor to rotate in synchronization with a second magic cube layer of the smart magic cube, wherein the stator includes a first sensing plate, a second sensing plate, and a fixing seat, the first sensing plate and the second sensing plate are fixedly mounted on both sides of the fixing seat, respectively, the first sensing plate is configured to sense a rotation signal of the first rotor, and the second sensing plate is configured to sense a rotation signal of the second rotor;

acquiring, by a main control module, a rotation signal of the first magic cube layer according to relative rotation between the first rotor and the stator;

acquiring, by the main control module, a rotation signal of the second magic cube layer according to relative rotation between the second rotor and the stator; and calculating, by the main control module, a real-time state of the smart magic cube according to the rotation signals of the first magic cube layer and the second magic cube layer.

* * * * *